US007494113B2

(12) United States Patent
Eberhardt et al.

(10) Patent No.: US 7,494,113 B2
(45) Date of Patent: Feb. 24, 2009

(54) CARBURETOR

(75) Inventors: Maximilian Eberhardt, Esslingen (DE); Patrick Schiauch, Esslingen (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 11/777,675

(22) Filed: Jul. 13, 2007

(65) Prior Publication Data

US 2009/0013963 A1 Jan. 15, 2009

(30) Foreign Application Priority Data

Jul. 13, 2007 (DE) ..... 10 2006 032 475

(51) Int. Cl.
*F02M 7/24* (2006.01)

(52) U.S. Cl. ..... 261/23.3; 123/73 PP; 261/46; 261/DIG. 1

(58) Field of Classification Search ..... 261/23.3, 261/46, 47, DIG. 1; 123/73 PP
See application file for complete search history.

(56) References Cited

U.S. PATENT DOCUMENTS 6,328,288 B1 * 12/2001 Gerhardy ..... 261/35
6,889,637 B2 * 5/2005 Rosskamp ..... 123/73 PP
7,011,298 B2 * 3/2006 Gerhardy et al. ..... 261/46
7,100,551 B2 * 9/2006 Rosskamp ..... 123/73 PP
7,357,377 B2 * 4/2008 Glover et al. ..... 261/46
2003/0106508 A1 * 6/2003 Rosskamp ..... 123/73 PP
2004/0051186 A1 * 3/2004 Gerhardy et al. ..... 261/43
2005/0073062 A1 4/2005 Zwimpfer et al.
2005/0120985 A1 * 6/2005 Rosskamp ..... 123/73 PP
2006/0107912 A1 * 5/2006 Hoche et al. ..... 123/73 A
2006/0163755 A1 * 7/2006 Prager ..... 261/46
2006/0219194 A1 * 10/2006 Geyer et al. ..... 123/73 A

* cited by examiner

*Primary Examiner*—Richard L Chiesa
(74) *Attorney, Agent, or Firm*—Robert W. Becker; Robert Becker & Assoc

(57) ABSTRACT

A carburetor having a carburetor body in which an intake channel portion is formed. At least one fuel opening opens out into the intake channel portion. Pivotably mounted in the intake channel portion is a butterfly valve that in a completely opened position divides the intake channel, in the region of the butterfly valve, into a mixture channel and a feed channel, so that in the completely opened position of the butterfly valve, flowing into the feed channel is combustion air having a fuel content that is less than the fuel content in the mixture channel. Provided in the intake channel portion is at least one partition section that extends between the feed channel and the mixture channel. The partition section is formed on the carburetor body.

14 Claims, 2 Drawing Sheets

CARBURETOR

The instant application should be granted the priority date of Jul. 13, 2006 the filing date of the corresponding German patent application 10 2006 032 475.7.

BACKGROUND OF THE INVENTION

The present invention relates to a carburetor.

U.S. 2005/0073062 A1 discloses a carburetor that has a butterfly valve. In order in the fully opened position of the butterfly valve to divide the intake channel into a mixture channel and an air channel, a partition section is inserted into the intake channel.

It is an object of the present invention to provide a carburetor of the aforementioned general type that can be manufactured in a straightforward manner.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
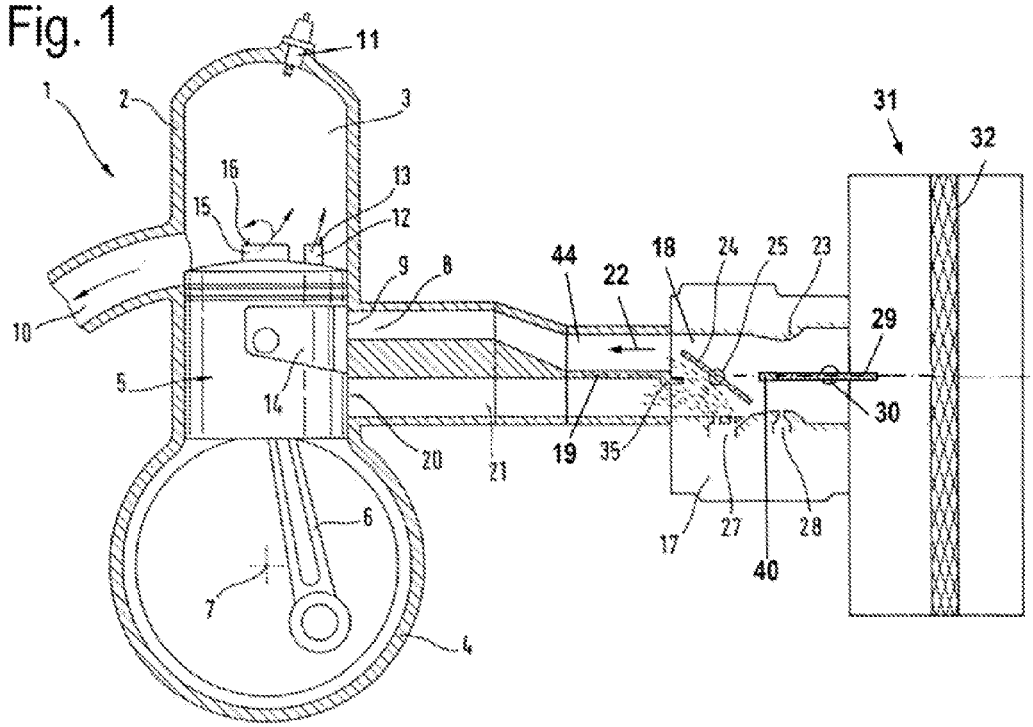
FIG. 1 illustrates a two-cycle engine having a carburetor.

The carburetor of the present application comprises a carburetor body, wherein a portion of an intake channel of an internal combustion engine is formed in the carburetor body, and wherein at least one fuel opening opens out into the intake channel portion. The carburetor also includes a butterfly valve pivotably mounted in the intake channel portion, wherein in a fully opened position the butterfly valve divides the intake channel, in the region of the butterfly valve, into a mixture channel and a feed channel in such a way that in the fully opened position of the butterfly valve, adapted to flow in the feed channel is combustion air having a fuel content that is less than a fuel content in the mixture channel. At least one partition section is disposed in the intake channel portion and extends between the feed channel and the mixture channel, wherein the at least one partition section is formed on the carburetor body.

Due to the fact that the partition section is formed on the carburetor body, no additional components are required. The carburetor body and the partition section can be formed in a single manufacturing step. Due to the fact that the partition section is formed on the carburetor body, the partition section can also have an inclined configuration relative to the longitudinal axis of the intake channel in a simple manner.

The carburetor body is advantageously manufactured in a casting process, and the partition section is cast on the carburetor body. During the manufacture of the carburetor body in a casting process, individual functional areas of the carburetor, for example a venturi section in the intake channel, can already be manufactured in such a way that no subsequent processing is any longer required. No separate manufacturing step is any longer required for producing the partition section. Forming the partition section on the carburetor body is particularly advantageous for a carburetor where, relative to the direction of flow in the intake channel, a choke valve is pivotably mounted in the intake channel portion upstream of the butterfly valve. In this connection, the partition section is advantageously disposed between the butterfly valve and the choke valve in the direction of flow. The region between the butterfly valve and the choke valve, in the longitudinal direction of the carburetor, is then only accessible if either the butterfly valve or the choke valve has not yet been installed. An insertion of a partition section into a region between a butterfly valve and a choke valve therefore requires a prescribed manufacturing sequence, thus making installation difficult. The region between the butterfly valve and the choke valve is generally no longer machined after the manufacture in a casting process, so that further processing steps are not made difficult or prevented by the partition section.

A venturi section is in particular formed in the intake channel section, and when viewed in the direction of flow at least one partition section is disposed at the level of the venturi section. No subsequent processing or machining of the intake channel section takes place in the region of the venturi section, so that there is no obstruction of machining of the carburetor body due to the partition section. Fuel is supplied to the intake channel in the region of the venturi section. It is therefore desirable in this region to limit or prevent fuel from passing into the feed channel. A partition section disposed between the butterfly valve and the choke valve can considerably reduce the quantity of fuel supplied to the feed channel.

The partition section is advantageously embodied as a flow guiding element. Configuration the partition section as a flow guiding element allows a defined influence upon the flow conditions in the intake channel section. In this connection, the flow guiding element is advantageously embodied in such a way that fuel does not pass into the feed channel. At the same time, the flow guiding element advantageously influences the pressure conditions in the mixture channel and in the feed channel in such a way that the greatest throttling of the flow cross-section is established in the region of the main fuel opening, i.e. of the venturi section, and is not produced by the butterfly valve shaft. This can be achieved by appropriate shaping of the flow guiding element. The flow guiding element advantageously has a flow profile on that side that faces the mixture channel. The flow profile expediently increasingly reduces the flow cross-section in the mixture channel in the direction of flow. The flow guiding element thereby prevents an abrupt reduction of the flow cross-section at the butterfly valve shaft. As a result, the resistance to flow is reduced in the region of the butterfly valve shaft. The greatest throttling of the mixture channel can thereby be achieved in the region of a venturi section.

The partition section extends over the entire width of the intake channel portion as measured transverse to the direction of flow. As a result, a very good separation of feed channel and mixture channel is achieved. A passage of mixture from the mixture channel into the feed channel is largely prevented in the region between the choke valve and the butterfly valve.

However, it is also possible to provide two partition sections between the butterfly valve and the choke valve that extend toward one another from the channel wall of the intake channel portion. This is particularly advantageous if it is difficult to produce a continuous partition section in the casting process due to the small wall thicknesses in a central region. By means of the partition sections that extend from the channel wall into the interior of the intake channel, it is possible to achieve an adequate influencing of the flow in the intake channel portion. As a result, a passage of fuel into the feed channel can be adequately avoided. In this connection, the partition sections are in particular spaced from one another.

Further specific features of the present invention will be described in detail subsequently.

DESCRIPTION OF SPECIFIC EMBODIMENTS

Referring now to the drawings in detail, FIG. 1 schematically shows an internal combustion engine, namely a two-cycle engine 1. The two-cycle engine 1 is embodied as a single-cylinder, two-cycle engine, and serves in particular for driving the tool of a manually guided implement, such as a cut-off machine, a power saw, a brushcutter, a trimmer, or the like. The two-cycle engine 1 has a cylinder 2, in which is formed a combustion chamber 3. The combustion chamber 3 is delimited by a piston 5 that is reciprocally mounted in the cylinder 2. By means of a connecting rod 6, the piston 5 drives a crankshaft 7 that is rotatably mounted in a crankcase 4.

The two-cycle engine 1 has an intake channel 44 that is connected to an air filter 31 via a carburetor 17. Disposed in the air filter 31 is filter material 32 that filters the combustion air that is drawn into the intake channel 44. Downstream of the carburetor 17, the intake channel 44 is divided by a partition 19 into a mixture channel 21 and a feed channel 8. During full-throttle operation, the feed channel 8 conveys combustion air having a fuel content that is less than the fuel content in the mixture channel 21. The combustion air in the feed channel 8 is fuel lean or largely fuel-free. The mixture channel 21 opens out at the cylinder 2 via a mixture inlet 20. The mixture inlet 20 is port-controlled by the piston 5, and in the vicinity of the upper dead center position of the piston 5 is opened relative to the crankcase 4. The feed channel 8 opens out at a channel inlet 9 at the cylinder 2 that in every position of the piston 5 is closed off by the piston 5 relative to the combustion chamber 3 and relative to the crankcase 4.

An outlet 10 for exhaust gases leads out of the combustion chamber 3. Extending into the combustion chamber 3 is a sparkplug 11 that ignites the fuel/air mixture in the combustion chamber 3. The two-cycle engine 1 has four transfer channels 12, 15 that are disposed at the cylinder 2 symmetrically relative to the section plane in FIG. 1. The two transfer channels 12 that are close to the inlet open into the combustion chamber 3 via transfer windows 13. The transfer channels 15 that are close to the outlet open into the combustion chamber 3 via transfer windows 16. The piston 5 has at least one piston pocket 14 that in the vicinity of the upper dead center position of the piston 5 connects the channel inlet 9 with the transfer windows 13 and 16, so that combustion air can flow out of the feed channel 8 into the transfer channels 12 and 15.

Formed in the carburetor 17 is an intake channel portion 18 in which is pivotally mounted a throttle element, namely a butterfly valve 24 that is disposed on a butterfly valve shaft 25. The partition 19 extends into the region of the butterfly valve 24. The partition 19 has an abutment surface 35 against which the butterfly valve 24 rests in the completely opened position. Auxiliary or secondary fuel openings 27 open into the mixture channel 21 in the region of the butterfly valve 24. In the intake channel 44, combustion air flows in the direction of flow 22 from the air filter 31 to the two-cycle engine 1. A choke valve 29 is disposed in the intake channel portion 18 upstream of the butterfly valve 24 relative to the direction of flow 22; the choke valve 29 is pivotably mounted via a choke shaft 30. A venturi section 23 is formed in the intake channel portion 18 in the region between the choke shaft 30 and the butterfly valve shaft 25; the flow cross-section in the intake channel portion 18 is constricted at the venturi section 23. A main fuel opening 28 opens into the mixture channel 21 in the region of the venturi section 23. Disposed between the choke valve 29 and the butterfly valve 24, in the direction of flow, is a partition section that is embodied as the flow guiding element 40.

Figure 2:
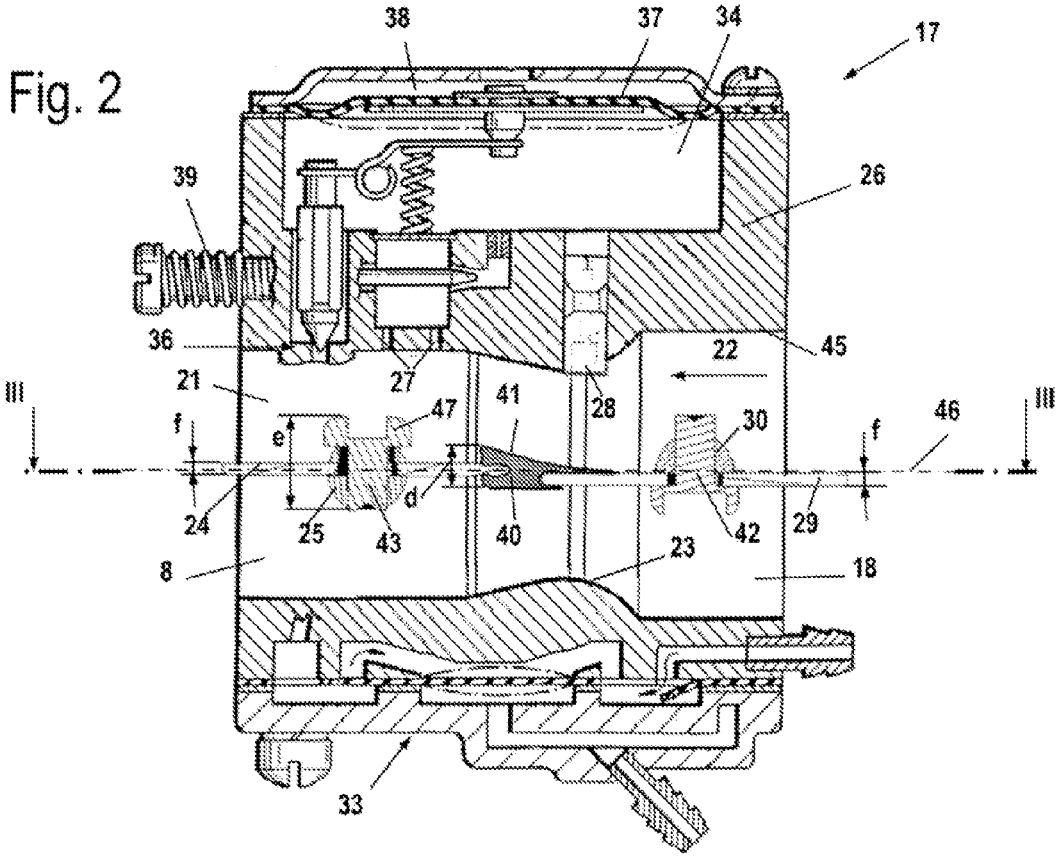
FIG. 2 is an enlarged, cross-sectional view of a carburetor.

In FIG. 2, the carburetor 17, which is embodied as a diaphragm carburetor, is shown enlarged. The carburetor 17 has a carburetor body 26 in which is formed the intake channel portion 18. If the butterfly valve 24 is in its fully opened position, as shown in FIG. 2, the butterfly valve 24 divides the intake channel portion 18 in the region of the butterfly valve into the feed channel 8 and the mixture channel 21. In contrast to the illustration in FIG. 1, in FIG. 2 the mixture channel 21 is disposed on the upper side. Opening into the mixture channel 21 are the fuel openings 27 and 28, which are supplied from a fuel-filled regulation chamber 34. The fuel is drawn into the intake channel 44 out of the regulation chamber 34 via the fuel openings 27, 28 as a function of the underpressure that exists in the intake channel portion 18. The regulation chamber 34 is separated from a compensation chamber 38 by a regulating diaphragm 37. The compensation chamber 38 can be connected with the atmosphere or the clean side of the air filter 31. The regulating diaphragm 37 actuates an inlet vale 36 via a lever mechanism. Additionally disposed in the carburetor body 26 is a fuel pump 33 that conveys the fuel to the inlet valve 36 and to the regulation chamber 34. An idling set screw 39 is provided for the adjustment of the quantity of fuel supplied to the secondary fuel openings 27.

The butterfly valve 24 is secured to the butterfly valve shaft 25 via a screw 43. The head 47 of the screw 43 narrows the flow cross-section in the mixture channel 21, and represents a throttling location. The butterfly valve shaft 25 also extends into the mixture channel 21 and forms a throttle. In the fully opened position of the butterfly valve 24, this can lead to a greater throttling of the flow in the mixture channel 21 in the region of the butterfly valve shaft 25 than in the region of the venturi section 23. This is undesired, since the greatest throttling, and hence the greatest underpressure, should exist in the region of the venturi section 23 in order to ensure an adequate supply of fuel. Disposed between the choke valve 29 and the butterfly valve 24 in the direction of flow 22 is a flow guiding element 40 that reduces the throttling produced by the butterfly valve shaft 25 and the head 47 of the screw 43 in the mixture channel 21. For this purpose, the flow guiding element 40 has a flow profile 41 on that side that faces the mixture channel 41. A flow profile can also be formed on the flow guiding element 40 on that side facing the feed channel 8 in order to influence the flow conditions in the intake channel 44. The flow profile 41 has a ramp-shaped configuration and increasingly reduces the flow cross-section in the mixture channel 21 in the direction of flow 22. When viewed in the direction of flow 22, the flow guiding element 40 extends increasingly into the mixture channel 21. On that side facing the butterfly valve shaft 25, the flow guiding element 41 has a thickness d, as measured perpendicular to the longitudinal axis 46 of the intake channel, that is greater than the thickness f of the butterfly valve 24, and the thickness f of the choke valve 29, as measured in the same direction, and is smaller than the thickness e of the butterfly valve shaft 25, as measured in the same direction, in the region of the screw 43, including the head 47 of the screw 43. The thickness d is advantageously two to four times the thickness f of the butterfly valve 24, and 0.3 to 0.8 times the thickness e of the butterfly valve shaft 25. The longitudinal axis 46 of the intake channel extends parallel to the direction of flow 22 in the geometrical center of the flow cross-section of the intake channel 44. The choke valve 29 is also secured via a screw 42 to the choke shaft 30.

Figure 3:
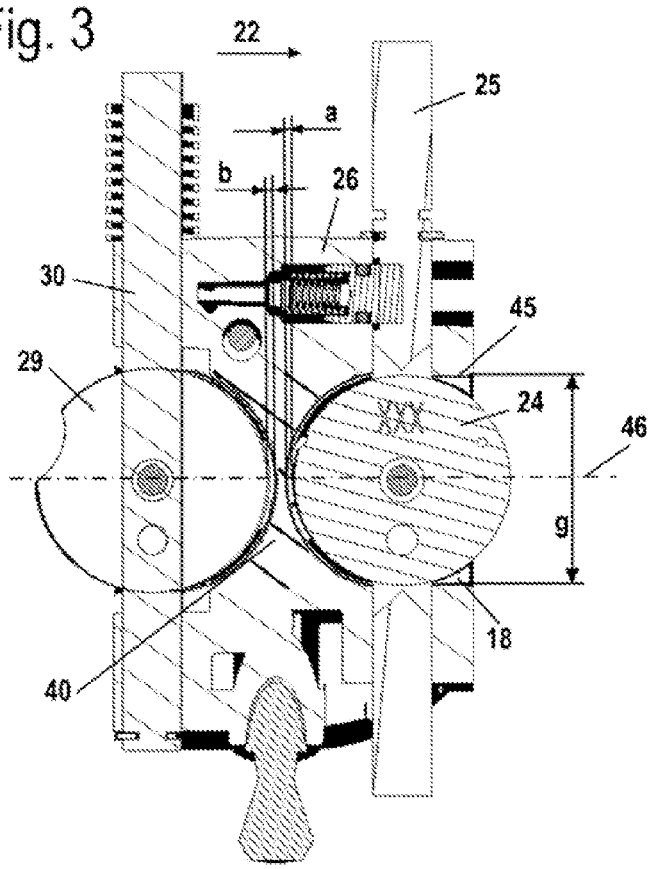
FIG. 3 is a cross-sectional view through the carburetor of FIG. 2 taken along the line III-III thereof.

As shown in the cross-sectional view of FIG. 3, the flow guiding element 40 extends over the entire width g as measured perpendicular to the longitudinal axis 46 of the intake channel in the plane of the butterfly valve shaft 25 and of the choke shift 30. The flow guiding element 40 is spaced from the butterfly valve 24 by a distance a at the periphery of the butterfly valve 24, and is spaced from the choke valve 29 by a distance b at the periphery of the choke valve 29. The distances or spacings a and b can be fractions of a millimeter up to several millimeters. The distances a, b are advantageously kept as small as possible. In this connection, however, the butterfly valve 24 or the choke valve 29 must be prevented from being blocked by the flow guiding element 40. The flow guiding element 40 extends between oppositely disposed channel walls 45 of the intake channel portion 18. The flow-guiding element 40 separates the feed channel 8 from the mixture channel 21. The flow guiding element 40 can also be provided with an abutment surface for the butterfly valve 24 and/or the choke valve 29, as shown in FIG. 1 for the partition 19 against the butterfly valve 24.

Figure 4:
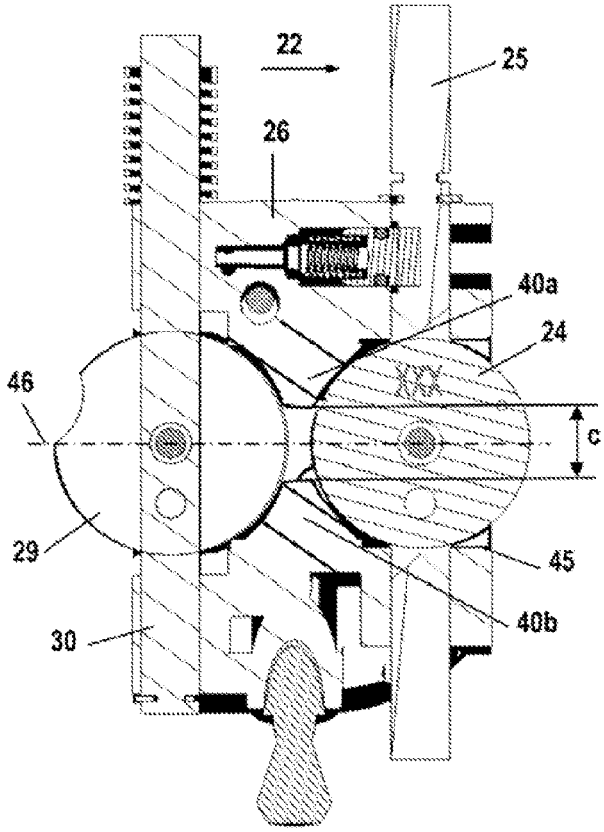
FIG. 4 is a cross-sectional view through a further exemplary embodiment of a carburetor at the level of the line III-III in FIG. 2.

In the embodiment illustrated in FIG. 4, two flow-guiding elements 40*a* and 40*b* are provided that in the direction of flow 22 extend between the choke valve 29 and the butterfly valve 24. The two flow guiding elements 40*a*, 40*b* extend from oppositely disposed sides of the intake channel portion 18, respectively extending from the channel wall 45 toward the longitudinal axis 46 of the intake channel and toward one another. In the region of the longitudinal axis 46 of the intake channel, the two flow guiding elements 40*a*, 40*b* are spaced from one another by the distance c.

The flow guide elements 40, 40*a*, 40*b* are monolithically formed on the carburetor body 26. During manufacture of the carburetor body 26 in a casting process, the flow guiding elements 40*a*, 40*b* are advantageously also formed on the carburetor body 26.

The specification incorporates by reference the disclosure of German priority document 10 2006 032 475.7 filed Jul. 13, 2006.

The present invention is, of course, in no way restricted to the specific disclosure of the specification and drawings, but also encompasses any modifications within the scope of the appended claims.

What we claim is:

1. A carburetor, comprising:

a carburetor body, wherein a portion of an intake channel of an internal combustion engine is formed in said carburetor body, and wherein at least one fuel opening opens out into said intake channel portion;

a butterfly valve pivotably mounted in said intake channel portion, wherein in a fully opened position said butterfly valve divides said intake channel, in a region of said butterfly valve, into a mixture channel and a feed channel in such a way that in said fully opened position of said butterfly valve adapted to flow in said feed channel is combustion air having a fuel content that is less than a fuel content in said mixture channel; and at least one partition section disposed in said intake channel portion and extending between said feed channel and said mixture channel, wherein said at least one partition section is formed on said carburetor body.

2. A carburetor according to claim 1, wherein said carburetor body is adapted to be manufactured in a casting process, and wherein said at least one partition section is adapted to be cast on said carburetor body.

3. A carburetor according to claim 1, wherein relative to a direction of flow in said intake channel, a choke valve is pivotably mounted in said intake channel portion upstream of said butterfly valve.

4. A carburetor according to claim 3, wherein in said direction of flow, said at least one partition section is disposed between said butterfly valve and said choke valve.

5. A carburetor according to claim 1, wherein a venturi section is formed in said intake channel portion, and wherein when viewed in a direction of flow in said intake channel, at least one partition section is disposed at a level of said venturi section.

6. A carburetor according to claim 1, wherein said at least one partition section is embodied as a flow guiding element.

7. A carburetor according to claim 6, wherein said flow guiding element is provided with a flow profile on a side that faces said mixture channel.

8. A carburetor according to claim 7, wherein said flow profile is adapted to increasingly reduce a flow cross-section in said mixture channel in a direction of flow in said intake channel.

9. A carburetor according to claim 1, wherein said at least one partition section extends over the entire width (g) of said intake channel portion as measured transverse to a direction of flow in said intake channel.

10. A carburetor according to claim 1, wherein two partition sections are disposed between said butterfly valve and a choke valve disposed in said intake channel portion, and wherein said two partition sections extend toward one another from a respective channel wall portion of said intake channel portion.

11. A carburetor according to claim 10, wherein said partitions sections are spaced (c) from one another.

12. A carburetor, comprising:

a carburetor body, wherein a portion of an intake channel of an internal combustion engine is formed in said carburetor body, and wherein at least one fuel opening opens out into said intake channel portion;

a butterfly valve pivotably mounted in said intake channel portion, wherein in a fully opened position said butterfly valve divides said intake channel, in a region of said butterfly valve, into a mixture channel and a feed channel in such a way that in said fully opened position of said butterfly valve adapted to flow in said feed channel is combustion air having a fuel content that is less than a fuel content in said mixture channel; and at least one partition section disposed in said intake channel portion and extending between said feed channel and said mixture channel, wherein said carburetor body is adapted to be manufactured in a casting process, and wherein at the same time said at least one partition section is adapted to be cast on said carburetor body and is thus monolithically formed on said carburetor body.

13. A carburetor, comprising:

a carburetor body, wherein a portion of an intake channel of an internal combustion engine is formed in said carburetor body, and wherein at least one fuel opening opens out into said intake channel portion;

a butterfly valve pivotably mounted in said intake channel portion, wherein in a fully opened position said butterfly valve divides said intake channel, in a region of said butterfly valve, into a mixture channel and a feed channel in such a way that in said fully opened position of said butterfly valve adapted to flow in said feed channel is combustion air having a fuel content that is less than a fuel content in said mixture channel; and at least two flow guiding elements disposed in said intake channel portion, wherein said flow guiding elements extend between said feed channel and said mixture channel, wherein said carburetor body is adapted to be manufactured in a casting process, and wherein said flow guiding elements are adapted to be cast on said carburetor body.

14. A carburetor according to claim 13, wherein said flow guiding elements are spaced from one another by a distance (c).

* * * * *

UNITED STATES PATENT AND TRADEMARK OFFICE

CERTIFICATE OF CORRECTION

PATENT NO. : 7,494,113 B2
APPLICATION NO. : 11/777675
DATED : February 24, 2009
INVENTOR(S) : Eberhardt et al.

It is certified that error appears in the above-identified patent and that said Letters Patent is hereby corrected as shown below:

Title Page,

Item [30] should read as follows:

[30] Foreign Application Priority Date

Jul. 13, 2006

Signed and Sealed this

Fifth Day of May, 2009

John Doll

JOHN DOLL
*Acting Director of the United States Patent and Trademark Office*